US008286947B2

(12) United States Patent
Rogelja

(10) Patent No.: US 8,286,947 B2
(45) Date of Patent: Oct. 16, 2012

(54) PULLEY APPARATUS

(75) Inventor: Boris Rogelja, Padstow (AU)

(73) Assignee: Capital Safety Group (Australia) Pty Limited, Sydney (AU)

( * ) Notice: Subject to any disclaimer, the term of this patent is extended or adjusted under 35 U.S.C. 154(b) by 15 days.

(21) Appl. No.: 12/936,112

(22) PCT Filed: Apr. 1, 2009

(86) PCT No.: PCT/AU2009/000399
§ 371 (c)(1),
(2), (4) Date: Nov. 18, 2010

(87) PCT Pub. No.: WO2009/121136
PCT Pub. Date: Oct. 8, 2009

(65) Prior Publication Data

US 2011/0068311 A1 Mar. 24, 2011

(30) Foreign Application Priority Data

Apr. 2, 2008 (AU) ..... 2008901588

(51) Int. Cl.
*B66D 3/08* (2006.01)

(52) U.S. Cl. ..... 254/393; 254/394; 254/397

(58) Field of Classification Search ..... 254/278, 254/283, 284, 285, 286, 332, 333, 334, 335, 254/336, 337, 338, 375, 391, 393, 394, 397, 254/399
See application file for complete search history.

(56) References Cited

U.S. PATENT DOCUMENTS 287,262 A * 10/1883 Evarts ..... 188/174
3,677,521 A * 7/1972 Kinnicutt, Jr. ..... 254/283
3,753,551 A * 8/1973 Tidwell ..... 254/334
(Continued)

FOREIGN PATENT DOCUMENTS

DE 3326819 2/1985
(Continued)

OTHER PUBLICATIONS

PCT International Search Report and the Written Opinion of the International Searching Authority, International Application No. PCT/AU2009/000399, Australian Patent Office, May 2009, 15 pages.

*Primary Examiner* — Emmanuel M Marcelo
(74) *Attorney, Agent, or Firm* — IPLM Group, P.A.

(57) ABSTRACT

A pulley apparatus (10), includes a dram (12) having a central axis mounted between two side plates (14, 16) for receiving a rope (120) passing around the drum. The dram (12) defines a cylindrical surface for receiving a rope or line. The pulley apparatus includes holes (14*a*, 16*a*) for hanging or supporting the pulley from a hook karabiner or the like. A rope guide means (30, 32) is defined on the underside of the pulley adjacent the dram and passing over the cylindrical surface of the dram for guiding the line to wrap around the central part of the dram and inhibiting overran of ropes. The guide means comprise two curved blades (30, 32) which extend from the side plates and bow out towards the center of the dram to define a convergent-divergent wasp-waisted passage for the line to pass through. A second single, freely rotatable sheave (40) is mounted to the apparatus between the lower ends of two plates (42, 44) whose upper ends are pivotally mounted to the side plates, and hangs below the guide means in use.

16 Claims, 5 Drawing Sheets

U.S. PATENT DOCUMENTS

| | | | | | |
|---|---|---|---|---|---|
| 3,822,834 | A | | 7/1974 | Fjarlie | |
| 3,946,989 | A | * | 3/1976 | Tsuda | 182/241 |
| 4,753,399 | A | | 6/1988 | Baum | |
| 4,770,394 | A | * | 9/1988 | Yang | 254/335 |
| 5,967,496 | A | * | 10/1999 | Ulrich et al. | 254/326 |
| 6,578,823 | B1 | * | 6/2003 | Johnson | 254/334 |

FOREIGN PATENT DOCUMENTS

| | | |
|---|---|---|
| GB | 527746 | 10/1940 |
| GB | 779312 | 7/1957 |

* cited by examiner

PULLEY APPARATUS

CROSS-REFERENCE TO RELATED APPLICATIONS

The present application claims priority from Australian Provisional Patent Application No 2008901588 filed on 2 Apr. 2008, the content of which is incorporated herein by reference.

FIELD OF THE INVENTION

This invention relates to an improved pulley apparatus.

BACKGROUND OF THE INVENTION

Pulleys are used for raising and lowering objects and/or people. In particular, pulleys may be used for lowering equipment or rescue workers from helicopters and lowering equipment or workers down shafts. A typical standard pulley comprises a wheel or sheave for carrying a rope, the sheave being rotatably mounted on an axle or the like which turns in a frame or block. Pulling at one end of the line (the haul end), will raise the weight or object attached at the other end of the line. Standard pulleys run very freely. When very heavy loads are being lowered, such free running of the pulley is disadvantageous, as the operator on the haul end of the line may have little control over the object at the other end of the line, particularly if the object is heavy or if the object accelerates and starts to descend rapidly. This control problem can be overcome by fixing the wheel/sheave, so that it is not able to turn and the rope merely slides over the surface of the sheave with the resultant increase in friction providing a greater degree of control for the operator. The sheave may comprise an elongate drum so that the line may be wrapped around the drum several times to increase the friction and consequently, increase the ease of control.

The problem with this approach, however, is that although a greater degree of control is provided when lowering an object, the increase in friction makes it more difficult to raise an object using fixed pulley. To solve this problem, it is known to provide one-way pulleys where the drum will turn in one direction only. Such pulleys can be used as either static pulleys or standard (free running) pulleys.

A further problem which arises with pulleys, is the tendency for the ropes to overrun which occurs when the ropes that are wrapped around the drum rub against each other and ride up over each other. This problem not only increases wear and tear on the rope, but may also reduce the control the operator has at the haul end of the line over the object being raised or lowered. It is known to put one or more pins at the top of static pulleys act as a rope guide. It is also known to mount a blade adjacent the top of a standard pulley to guide the rope and prevent screwing of the rope on the drum. The problem with this is that it limits the number of turns of rope that may be wound round the drum to one turn, where one blade is provided.

A yet further problem with existing pulleys, is that while pulleys are useful for lowering objects, a lack of mechanical advantage in existing pulleys means that it is usually difficult to raise and lower an object or person, except by using a lower pulley having two or more sheaves below the main pulley. However the problem with this is that more rope is needed passing between the main pulley and sheaves of the lower pulley.

The present invention seeks to alleviate some of the above mentioned problems of existing pulleys.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

SUMMARY OF THE INVENTION

In accordance with the present invention there is provided a pulley apparatus, including a drum having a central axis mounted between two side plates for receiving a rope passing around the drum, the drum defining a cylindrical surface for receiving a rope or line, the pulley being mounted between the two side plates, the pulley apparatus including a means for hanging or supporting the pulley and a rope guide means disposed on the underside of the pulley adjacent the drum and passing over the cylindrical surface of the drum for guiding the line to wrap around the central part of the drum for inhibiting overrun of ropes, and wherein a second sheave is mounted to the apparatus, disposed below the guide means in use.

Typically the second sheave is a single sheave and is freely rotatable. It is typically pivotally mounted to one or both of the side plates by a arm having a fixed length. It may be mounted between the lower ends of two plates whose upper ends are pivotally mounted to the side plates.

The guide means may be defined by two curved blades which extend from the side plates and bow out towards the centre of the drum to define a convergent-divergent wasp-waisted passage for the line to pass through.

It has been found that the provision of such a guide means at the bottom of the pulley where the line meets the drum provides sufficient correction to the line to ensure that it wraps properly around the drum and tends not to bunch or overrun. This contrasts with applying a correction to the line at the top of the drum by which point some twisting of the line might already have occurred making correction more difficult to effect.

It is preferred that a guide ring or the like, is provided adjacent each of the curved blades.

The pulley may be a static pulley with a fixed sheave, a standard pulley having a rotatable sheave or a one way pulley.

In a preferred embodiment, one side plate is fixed relative to the sheave, and the other plate is rotatable relative to the first plate for ease of threading a line around the sheave.

BRIEF DESCRIPTION OF THE DRAWINGS

A specific embodiment of the present invention will now be described, by way of example only, and with reference to the accompanying drawings in which.

DETAILED DESCRIPTION OF A PREFERRED EMBODIMENT

Figure 1:
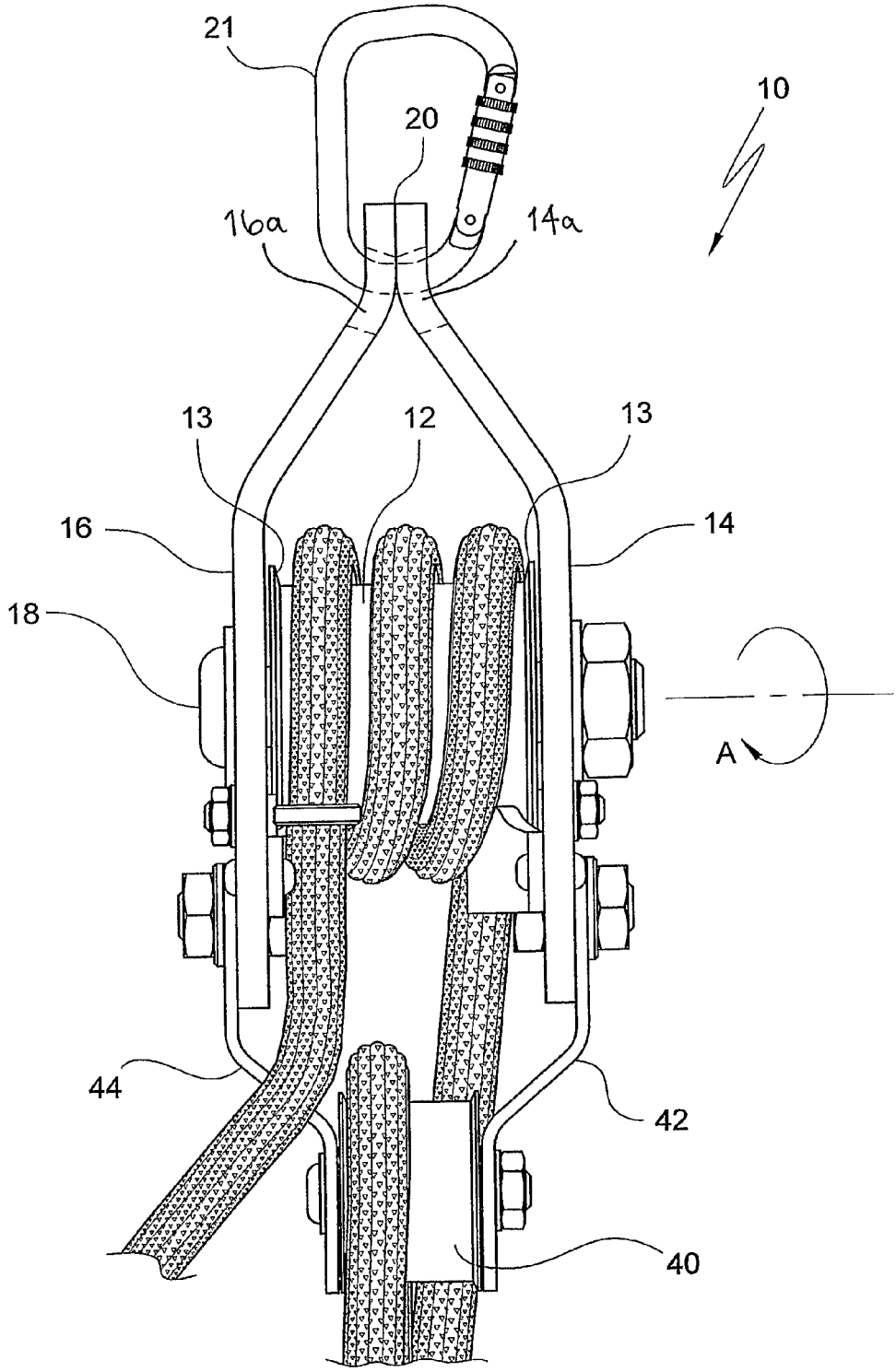
FIG. 1 is a front view of pulley apparatus embodying the present invention.

Referring to the drawings, FIG. 1 shows a main pulley generally indicated at 10. The pulley includes a cylindrical drum or sheave 12 having side rims 13, which is mounted between two cheeks in the form of side plates 14 and 16 on an axle 18 defining an axis. In the described embodiment, a one way mechanism (which can be any suitable one way mechanism such as a sprag clutch, or the like) is provided between the axle and the drum such that the drum will freely rotate about the axis in one direction "A" but will not rotate in the opposite direction. Thus, the pulley can act as a rotatable pulley in one direction ("A") and a static pulley in the other direction.

As can be seen from FIG. 1, the plates 16, 18 are parallel where they sandwich the sheave 12 and converge to meet at an upper end 20 of the pulley. At the upper end 20, each plate defines a hole 14*a*, 16*a*, respectively. The pulley can be suspended from the holes by a karabiner 21, hook (not shown) or similar device. The plates may rotate relative to each other about the axle 18 for ease of threading a rope around the sheave.

Figure 3:
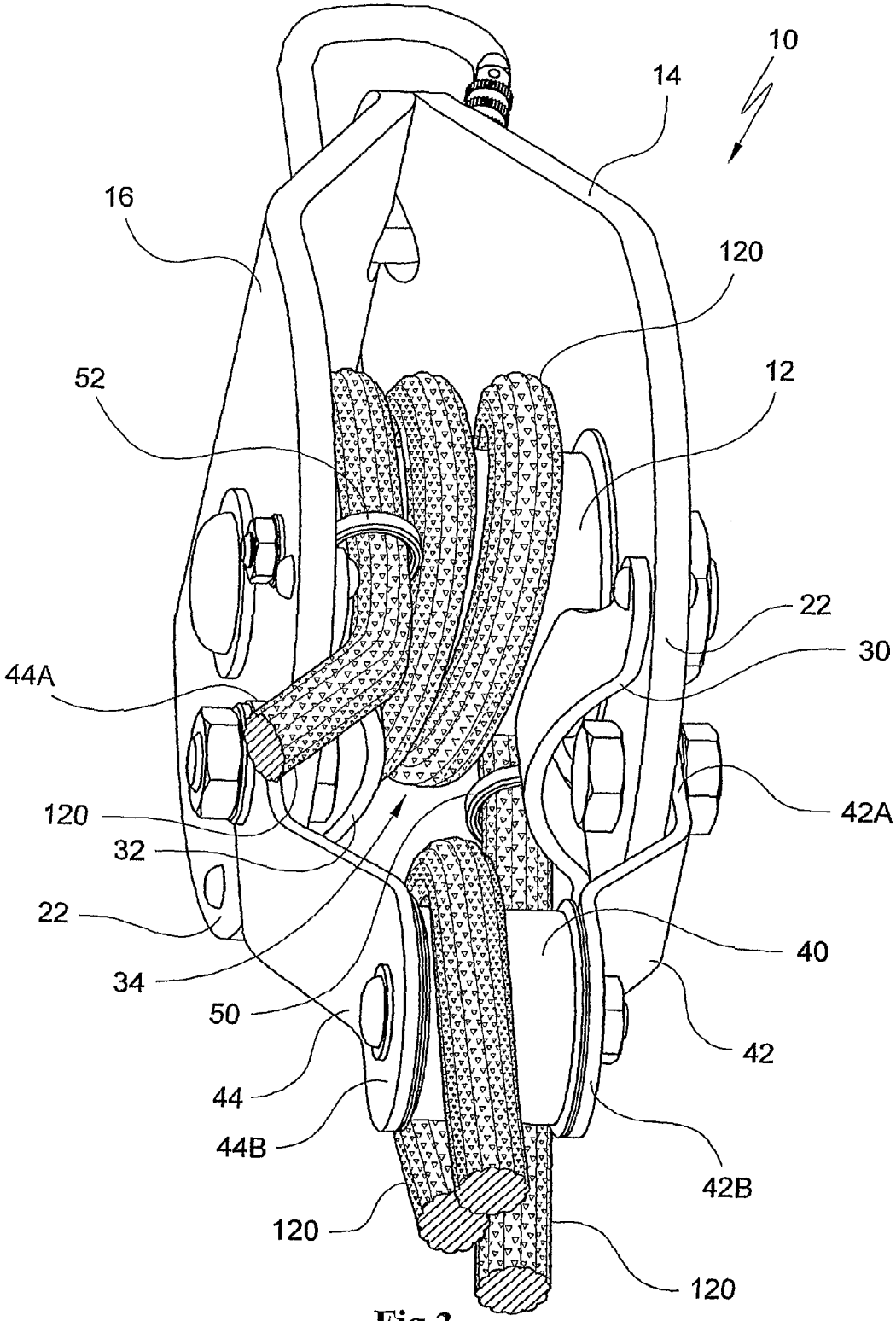
FIG. 3 is a view of the underside of the pulley of FIG. 1.

As is best seen in FIG. 3, a rope guide means in the form of two curved blades 30 and 32 are riveted to the plates 14 and 16 respectively at the lower end 22 of the pulley, below the sheave 12, in use. The upper surface of each blade is curved to approximately the same curvature as the cylindrical surface of the sheave 12. As shown in FIG. 3, the blades 30, 32 extend inwardly towards each other towards the centre of the underside of the drum to define a convergent-divergent wasp-waisted relatively narrow passage for the rope to pass through, enclosed either side by the blades. The gap 34 between the blades at the narrowest part of the passage is about 25 mm—wide enough for two side by side turns of a 12 mm diameter rope.

Figure 2:
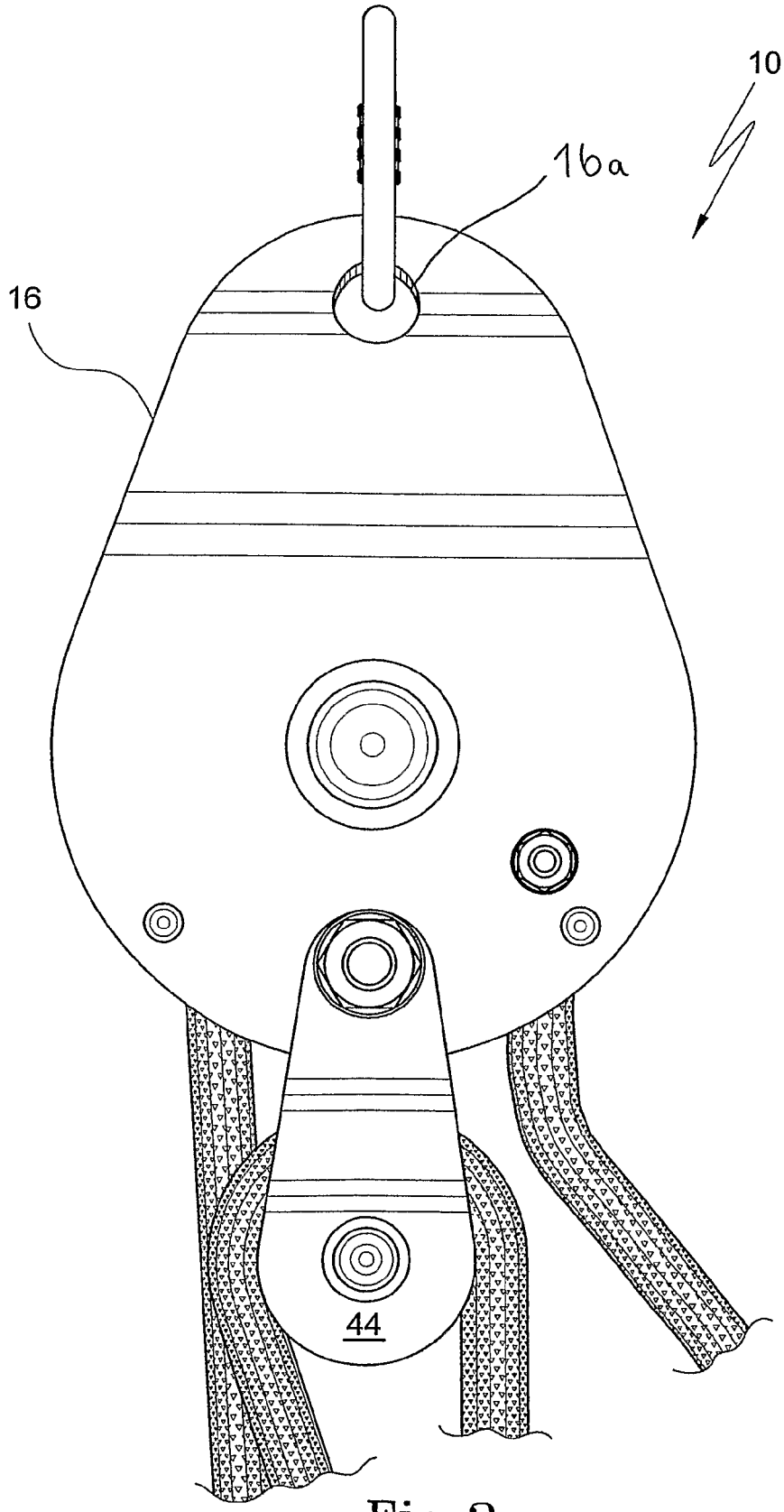
FIG. 2 is a side view of the pulley apparatus of FIG. 1.

FIGS. 1 to 3 also show a second relatively smaller single sheave 40, or lower sheave, which is pivotally mounted below the main sheave by means of two arms in the form of kinked plates 42, 44. One upper end 42*a*, 44*a* of each plate is pivotally mounted by a bolt to the respective side plate 14, 16 of the pulley, adjacent the blades 32, 30. The plates then converge towards each other at their lower ends 42*b*, 44*b*. The sheave 40 is mounted between the distal ends of the plates 40, 42. The sheave 40 is rotatable in both directions.

Also shown in FIG. 3 are two retaining or guide rings 50, 52. They function to constrain the rope that is passing around the sheave 12 as it passes onto and leaves the sheave respectively.

This ensures better alignment of the rope when the pulley is in use and in co-operation with the rope guide means helps prevent over-run of the rope.

Figure 4:
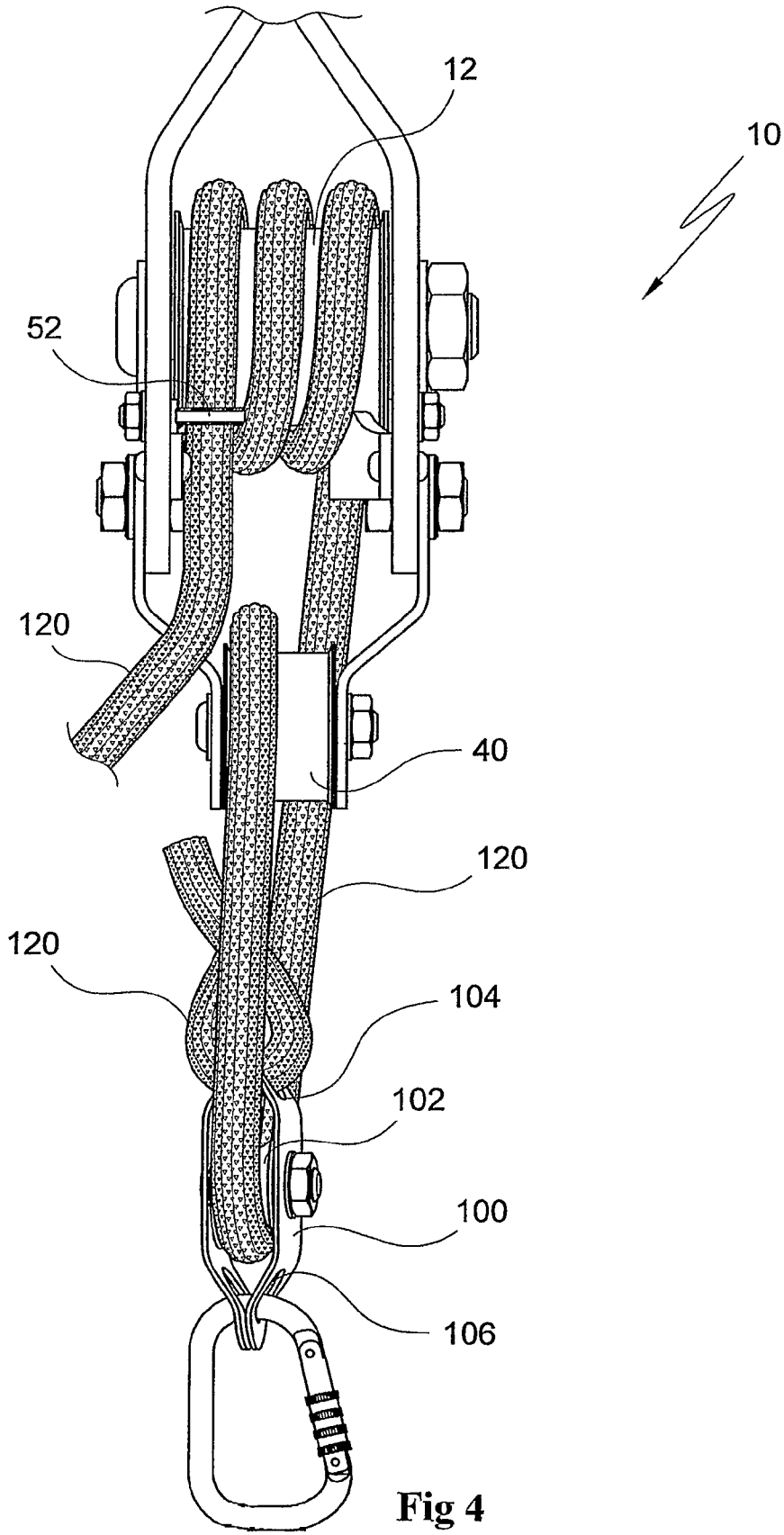
FIG. 4 is a front view of the pulley apparatus and an associated lower pulley.
Figure 5:
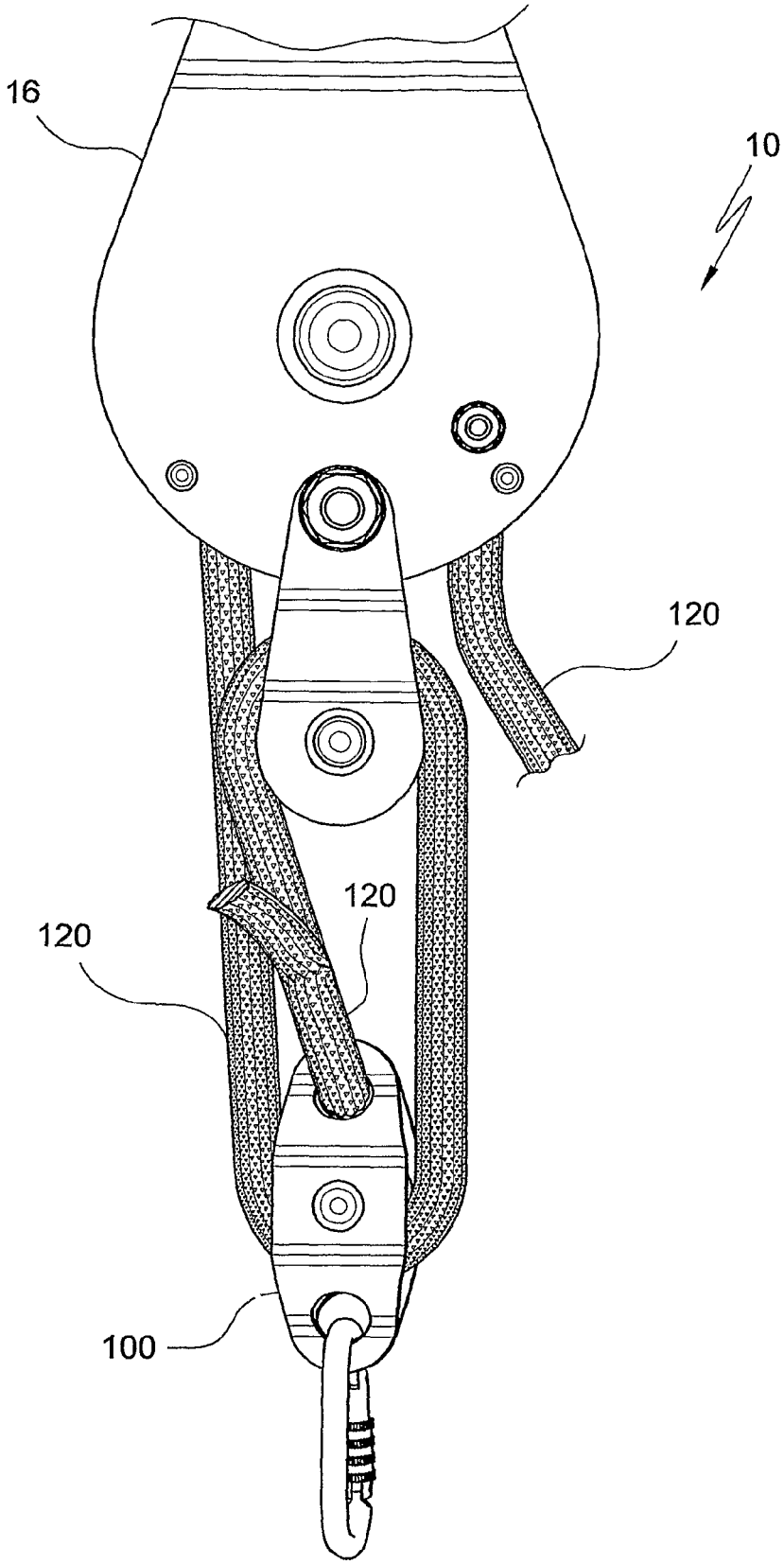
FIG. 5 is a side view of the pulley apparatus and associated lower pulley shown in FIG. 4.

FIGS. 4 and 5 illustrate the pulley 10 in use with a second lower pulley 100, having a single rotatable sheave 102. The pulley defines a first, or upper hole 104 as oriented in FIG. 4 and a second, or lower hole 106.

In use, and as shown in the Figure, a rope 120 is attached to the upper hole 104 of the lower pulley and passes up towards the lower sheave 40 of the main pulley 10, passing around that sheave 40 and down towards the lower pulley and around the movable sheave 102 of that lower pulley. The rope 120 then travels upwards, passes through one guide ring 52 and is wound three times around the one way sheave 12 before passing through the other guide ring 50.

By providing the second lower sheave 40 hanging from the main pulley, a mechanical advantage of 3 to 1 is provided without a major increase in required rope length. By pulling on the free or haul end of the rope the lower pulley and a person or object attached to the pulley can be safely and easily raised (by virtue of the 3 to 1 mechanical advantage) as well as lowered.

The diameter of the rope determines the number of turns which will fit side by side in the gap 34. The described embodiment is best suited to 12 mm diameter rope or similar.

It has been found that the provision of such a guide means 30, 32 at the bottom of the pulley where the line winds on to the drum provides sufficient correction to the line to ensure that it wraps properly around the centre of the drum and tends not to contact the side rims 13 of the drum or the cheeks 14 and 16 and which does not bunch, overrun. or screw to tightly onto the drum. This provides less unwanted rubbing and reduces the wear and tear on the line and provides more control of the pulley for an operator.

It will be appreciated by persons skilled in the art that numerous variations and/or modifications may be made to the invention as shown in the specific embodiments without departing from the scope of the invention as broadly described. The present embodiments are, therefore, to be considered in all respects as illustrative and not restrictive.

The invention claimed is:

1. A pulley apparatus comprising:

a drum having a central axis mounted between two side plates for receiving a rope passing around the drum, the drum defining a cylindrical surface for receiving a line;

a rope guide disposed on an underside of the pulley apparatus adjacent the drum and passing over the cylindrical surface for inhibiting overrun of the line as the line is guided to wrap around the cylindrical surface of the drum, the rope guide including, a pair of curved blades, each curved blade extending from an associated one of the two side plates, the pair of curved blades bowing out towards a center of the drum to define a convergent wasp-waisted passage for the line to pass through; and a second sheave is mounted to the pulley apparatus by at least one arm the at least one arm coupled to an associated one of the two side plates, the at least one arm spacing the second sheave from the rope guide and drum.

2. A pulley apparatus as claimed in claim 1, wherein the second sheave is a single sheave and is freely rotatable.

3. A pulley apparatus as claimed in claim 2 wherein the at least one arm includes a first and a second arm, the second sheave being mounted between ends of first and second arms whose opposite ends are pivotally mounted to the side plates.

4. A pulley apparatus as claimed in claim 1, further comprising: at least one guide ring for receiving the line through, the at least one guide ring coupled adjacent an associated curved blade.

5. A pulley apparatus as claimed in claim 1, wherein a narrowest part of the passage is about 25 mm in width.

6. A pulley apparatus as claimed in claim 1, wherein the pulley is a static pulley with a fixed sheave.

7. A pulley apparatus as claimed in claim 1, wherein the pulley is a standard pulley with rotatable sheave.

8. A pulley apparatus as claimed in claim 1, wherein the pulley is a one way pulley.

9. A pulley apparatus comprising:

a pair of side walls;

a first sheave rotationally coupled between the pair of sidewalls, the first sheave configured and arranged to rotate in only one direction, the first sheave having a first sheave cylindrical surface upon which a rope can be wrapped around;

a pair of guide blades, each guide blade coupled to an associated side wall proximate the first sheave, the guide blades extending towards each other to form a passage in which the rope can pass through to the first sheave;

a pair of arms, each arm having a first end pivotally coupled to an associated side wall; and a second sheave rotationally coupled between second ends of the arms, wherein the second sheave can move relative to the first sheave due to the first ends of the pair of arms being pivotally coupled to the side walls, the second sheave configured and arranged to freely rotate in both directions, the second sheave having a second sheave cylindrical surface to engage the rope.

10. The pulley apparatus of claim 9, further comprising:

each guide blade having a surface curved to approximate the curvature of the first sheave cylindrical surface of the first sheave.

11. The pulley apparatus of claim 9, wherein the passage formed between the guide blades is a wasp-waisted passage for the rope to pass through.

12. The pulley apparatus of claim 9, further comprising:

at least one guide ring for receiving the rope through, the at least one guide ring coupled adjacent an associated guide blade.

13. A pulley apparatus comprising:

a pair of side walls each having a first end and a second opposed end, the side walls converging at the respective first ends, the converged first ends of the side walls including a hole used for attachment of the pulley apparatus;

a first sheave rotationally coupled between the pair of sidewalls, the first sheave having a first sheave cylindrical surface upon which a rope can be wrapped around;

a pair of guide blades, each guide blade coupled to an associated side wall proximate the first sheave, the guide blades extending towards each other to form a relatively narrow passage in which the rope can pass through;

at least one guide ring for receiving the rope through, the at least one guide ring coupled adjacent an associated guide blade;

a pair of arms, each arm having a first end pivotally coupled proximate the second end of an associated side wall; and a second sheave rotationally coupled between second ends of the arms the second sheave having a second sheave cylindrical surface to engage the rope.

14. The pulley apparatus of claim 13, wherein the first sheave is configured and arranged to rotate in only one direction.

15. The pulley apparatus of claim 13, further comprising:

each guide blade having a surface curved to approximate the curvature of the first sheave cylindrical surface of the first sheave.

16. The pulley apparatus of claim 13, wherein the passage formed between the guide blades is a wasp-waisted passage for the rope to pass through.

* * * * *